US009640358B2

(12) United States Patent
Kostamo et al.

(10) Patent No.: US 9,640,358 B2
(45) Date of Patent: May 2, 2017

(54) REINFORCED RADIATION WINDOW, AND METHOD FOR MANUFACTURING THE SAME

(75) Inventors: Esa Kostamo, Helsinki (FI); Jari Kostamo, Helsinki (FI); Pasi Kostamo, Espoo (FI); Marco Mattila, Espoo (FI); Pekka Torma, Espoo (FI); Heikki Sipila, Espoo (FI)

(73) Assignee: HS FOILS OY, Espoo (FI)

( * ) Notice: Subject to any disclaimer, the term of this patent is extended or adjusted under 35 U.S.C. 154(b) by 115 days.

(21) Appl. No.: 14/422,878

(22) PCT Filed: Aug. 22, 2012

(86) PCT No.: PCT/FI2012/050804

§ 371 (c)(1),
(2), (4) Date: Jun. 30, 2015

(87) PCT Pub. No.: WO2014/029900

PCT Pub. Date: Feb. 27, 2014

(65) Prior Publication Data

US 2015/0357150 A1 Dec. 10, 2015

(51) Int. Cl.
*H01J 35/18* (2006.01)
*H01J 5/18* (2006.01)

(52) U.S. Cl.
CPC ..... *H01J 5/18* (2013.01); *H01J 35/18* (2013.01); *H01J 2235/18* (2013.01); *H01J 2235/183* (2013.01)

(58) Field of Classification Search
CPC .. H01J 2235/18; H01J 2235/183; H01J 35/18; H01J 5/18
See application file for complete search history.

(56) References Cited

U.S. PATENT DOCUMENTS 6,803,570 B1 * 10/2004 Bryson, III ..... H01J 33/04 250/305
7,737,424 B2 * 6/2010 Xu ..... H01J 5/18 250/374
2004/0251229 A1 12/2004 Okumura et al.
2004/0251431 A1 * 12/2004 Yamaguchi ..... H01J 33/04 250/492.3
2006/0144778 A1 7/2006 Grunthaner et al.
2007/0111617 A1 * 5/2007 Meilahti ..... H01J 5/18 442/1
2008/0296518 A1 12/2008 Xu et al.
(Continued)

FOREIGN PATENT DOCUMENTS

EP 1 788 605 A2 5/2007
WO 2011/151506 A1 12/2011

OTHER PUBLICATIONS

International Search Report, dated Jun. 5, 2013, from corresponding PCT application.

(Continued)

*Primary Examiner* — Wyatt Stoffa
(74) *Attorney, Agent, or Firm* — Young & Thompson

(57) ABSTRACT

A radiation window foil is provided for an X-ray radiation window. It includes a continuous window layer with a first side and a second side. A first mesh or grid layer is stacked on or bonded to the first side of the continuous window layer. A second mesh or grid layer is stacked on or bonded to the second side of the continuous window layer.

19 Claims, 6 Drawing Sheets

(56) References Cited

U.S. PATENT DOCUMENTS

| | | | | |
|---|---|---|---|---|
| 2008/0317209 | A1* | 12/2008 | Sipila | G03F 1/22 378/140 |
| 2009/0173897 | A1* | 7/2009 | Decker | G21K 1/00 250/505.1 |
| 2010/0243895 | A1* | 9/2010 | Xu | H01J 5/18 250/336.1 |
| 2011/0311029 | A1* | 12/2011 | Andersson | H01J 5/18 378/161 |

OTHER PUBLICATIONS

Supplementary European search report, dated Feb. 29, 2016; Application No. 12 88 3312.

* cited by examiner

REINFORCED RADIATION WINDOW, AND METHOD FOR MANUFACTURING THE SAME

TECHNICAL FIELD

The invention concerns the technical field of radiation window foils and radiation windows. Especially the invention concerns a radiation window structure that has very low unwanted absorption of X-rays and good tolerance of pressure differences even if the window is large, and even if the window needs to tolerate wide variations in temperature.

BACKGROUND OF THE INVENTION

A radiation window is a structural element with an opening arranged for electromagnetic radiation to pass through. In most cases a radiation window foil covers the opening, separating for example the inside of e.g. a detector apparatus from its outside. The radiation window foil should absorb the desired radiation as little as possible, but it must simultaneously be strong enough and pinhole-free to withstand and maintain a pressure difference.

FIGS. 1 and 2 illustrate a known method for manufacturing a radiation window. This method has been described for example in the PCT publication number WO2011/151506. The topmost step in FIG. 1 illustrates a carrier 101, at least one surface of which has been polished and faces upwards. An etch stop layer 102 is produced on the polished surface of the carrier 101. If the carrier 101 is made of silicon, advantageous material for the etch stop layer 102 include but are not limited to silicon nitride and silicon oxide. At the third step of FIG. 1, a solid layer 103 is bonded on the etch stop layer 102.

In the fourth step from above in FIG. 1, the solid layer 103 is first thinned into a predetermined thickness and then patterned with a predetermined pattern of differences in thickness. In particular, regularly spaced portions of the originally uniform solid layer 103 are removed to turn said uniform layer into a mesh, a rib of which is illustrated as 104. A conformal diffusion barrier layer 105 is formed on top of the mesh, and a visible light blocking layer 106 is added in the radiation window foil.

In FIG. 2 the starting point is the same at which the first part of the method ended in FIG. 1: on top of a carrier 101 (such as a 6-inch silicon wafer, for example) there exist layers, of which the mesh layer is most clearly visible due to the visible cross sections of the mesh ribs (although also in this drawing the dimensions have only be selected for graphical clarity and are not in scale). In the next step the carrier with the layers on its surface is cut into blanks, of which blank 201 is an example. In the third step of FIG. 2 each blank is glued, soldered, welded or otherwise attached to a radiation window frame or support structure. Of these, support structure 202 is shown as an example. The last step in FIG. 2 shows removing the carrier, which is most advantageously done by etching.

FIG. 3 illustrates an alternative to the first part of the method illustrated in FIG. 1. The method portion of FIG. 3 has also been described in detail in the patent publication number WO2011/151506. The first four steps in FIG. 3 may be similar to those of FIG. 1, with the exception that the etch stop layer may be even thinner than in FIG. 1, for which reason it is referred to as layer 301. The fifth step of FIG. 3 illustrates producing a layer 302, which meanders around the ribs 104 of the mesh and constitutes the main layer of the foil portions that span the openings in the mesh. Further layers, such as a diffusion barrier 105 and/or a visible light blocking layer, can be added on top of layer 302, as is illustrated in the last step of FIG. 3. After that the method illustrated in FIG. 3 continues in conformity with the steps of FIG. 2 explained above.

Despite their numerous advantageous features, radiation windows and window foils produced with the methods of FIGS. 1 to 3 still leave room for improvement in respect of low absorption versus high strength, especially if the opening that the window foil must cover is large.

SUMMARY OF THE INVENTION

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to a more detailed description of exemplifying embodiments of the invention.

In accordance with a first aspect of the invention, there is provided a radiation window foil for an X-ray radiation window. The radiation window foil comprises:

- a continuous window layer with a first side and a second side,
- a first mesh or grid layer stacked on or bonded to said first side of said continuous window layer, and
- a second mesh or grid layer stacked on or bonded to said second side of said continuous window layer.

In accordance with a second aspect of the invention, there is provided a radiation window. The radiation window comprises:

- a radiation window frame that defines an opening, and
- a radiation window foil of the kind described above that is fixedly attached to said radiation window frame and seals said opening.

In accordance with a third aspect of the invention, there is provided a method for manufacturing a radiation window foil. The method comprises:

- providing a stacked and/or bonded layered structure in which an etch stop layer is between a first etchable layer and a second etchable layer,
- etching away portions of the first etchable layer to produce a first mesh or grid layer on a first side of said etch stop layer, and
- etching away portions of the second etchable layer to produce a second mesh or grid layer on a second side of said etch stop layer.

Various exemplifying embodiments of the invention both as to constructions and to methods of operation, together with additional objects and advantages thereof, will be best understood from the following description of the exemplifying embodiments when read in connection with the accompanying drawings.

The exemplifying embodiments of the invention presented in this document are not to be interpreted to pose limitations to the applicability of the appended claims. The verb "to comprise" is used in this document as an open limitation that neither excludes nor requires the existence of also unrecited features. The features recited in depending claims are mutually freely combinable unless otherwise explicitly stated.

DETAILED DESCRIPTION OF EMBODIMENTS OF THE INVENTION

Figure 1:
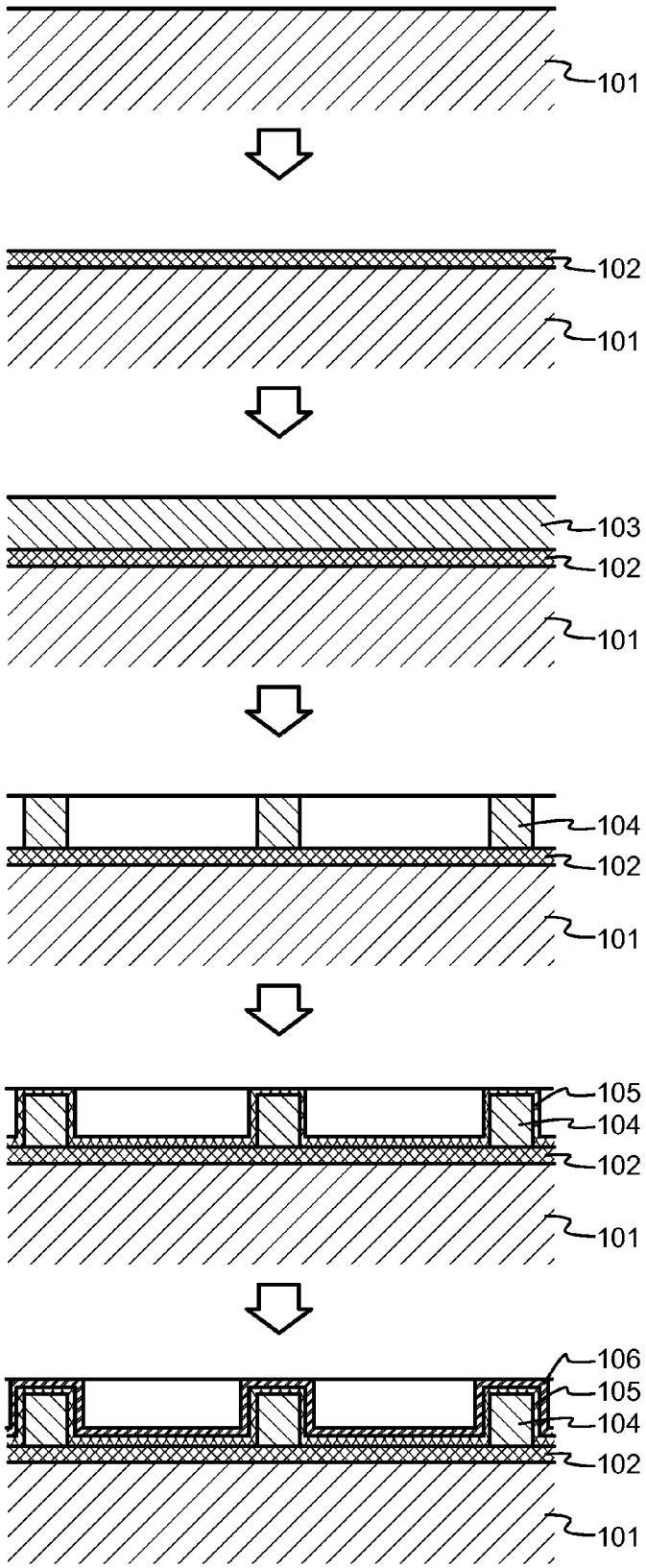
Fig. 1 PRIOR ART
FIG. 1 illustrates a first part of a known method for manufacturing a radiation window.
Figure 2:
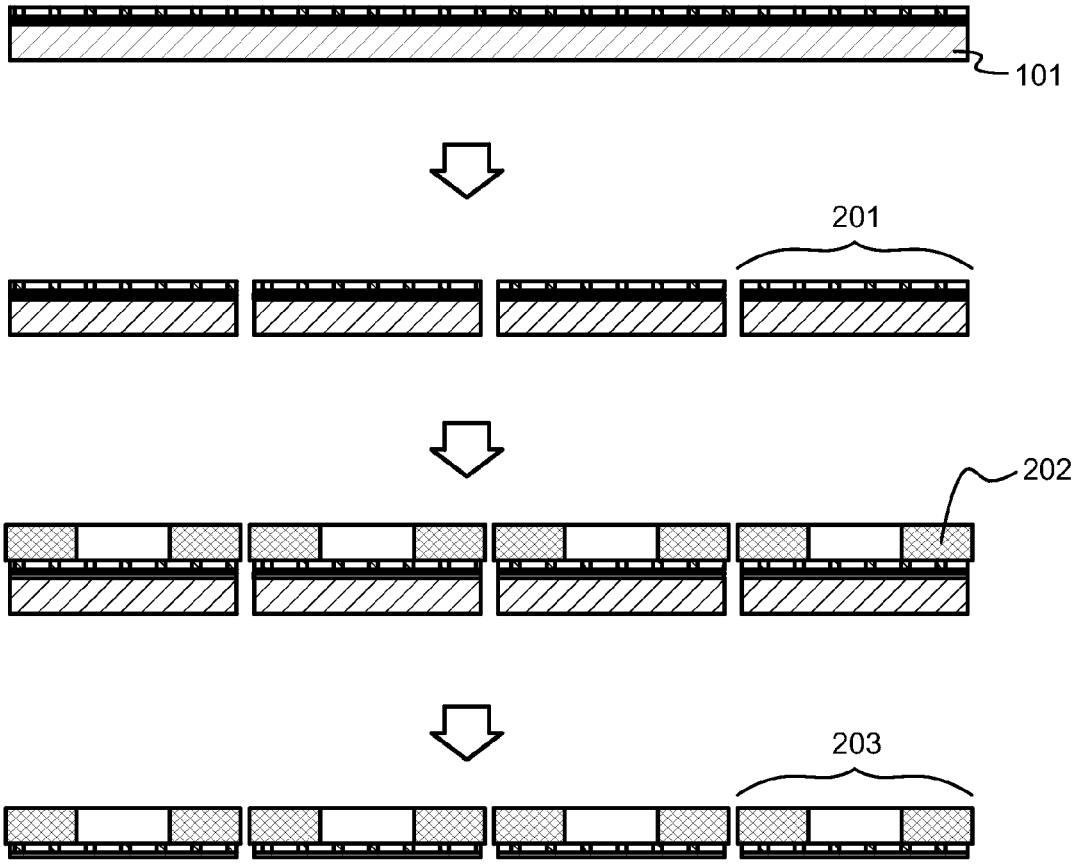
Fig. 2 PRIOR ART
FIG. 2 illustrates a second part of the method of FIG. 1.

In this description we use the following vocabulary concerning quasi-two-dimensional structural elements. A layer means a quantity of essentially homogeneous material that by its form has much larger dimensions in two mutually orthogonal directions than in the third orthogonal direction. In most cases of interest to the present invention, the dimension of a layer in said third orthogonal direction (also referred to as the thickness of the layer) should be constant, meaning that the layer has uniform thickness. A foil is a structure, the form of which may be characterised in the same way as that of a layer (i.e. much larger dimensions in two mutually orthogonal directions than in the third orthogonal direction) but which is not necessarily homogeneous: for example, a foil may consist of two or more layers placed and/or attached together. A mesh is a special case of a layer or foil, in which the constituents do not make up a continuous piece of material but define an array of (typically regular, and regularly spaced) openings. A grid is a special case of a mesh, comprising essentially parallel beams that extend across the whole area covered by the grid, so that the openings mentioned above are the elongated slits that remain between the beams.

Additionally we use the following vocabulary concerning window foils and windows. A radiation window foil is a foil that has suitable characteristics (low absorption, sufficient gastightness, sufficient mechanical strength etc.) for use in a radiation window of a measurement apparatus. A radiation window is an entity that comprises a piece of radiation window foil attached to a (typically annular) support structure so that electromagnetic radiation may pass through an opening defined by the support structure without having to penetrate anything else than said piece of radiation window foil and the (typically gaseous) medium that otherwise exists within said opening.

Additionally we use the following vocabulary concerning the interfacing of adjacent layers. Two layers are stacked together, or one layer is stacked on the other, when they form an integral structure and when their stacked configuration has come into existence without both layers existing previously in separate layer form. Thus, for example, when a thin film deposition method (such as chemical vapour deposition, atomic layer deposition, pulsed laser deposition or the like) is used to form or "grow" a new material layer onto a previously existing material layer, as a result the new layer becomes stacked on the previously existing material layer. Other examples of methods that produce stacked layers are ion implantation, annealing, and other surface treatments, which cause the characteristics of a treated surface up to a certain depth to change sufficiently so that the affected portion will behave differently than the material portion(s) below it. As a result, the affected portion constitutes a layer stacked together with the other layer(s) constituted by the material portion(s) below it.

Contrary to stacking, two layers are sandwiched together, or one layer is sandwiched on the other, when both layers existed in layer form before their configuration as two solid parts of a layered structure came into existence. It should be noted that sandwiching as a term does not exclude attaching, even relatively tightly, the layers to each other. As an example of sandwiching, a known manufacturing technique of SOI (Silicon On Insulator) wafers comprises bringing two highly polished pieces of silicon together, so that they become bonded by van der Waals forces. Bonded layers are thus a special case of sandwiched layers. Spreading a liquid substance onto a solid surface and subsequently allowing the liquid substance to solidify is another special case of sandwiching, because what becomes the solid top layer previously existed as a liquid layer before the configuration came into existence where two solid layers are adjacent to each other. Clearly sandwiched configurations are such where two previously manufactured foils are laminated together, or a separate reinforcement grid or mesh is placed adjacent to a radiation window foil to enhance its mechanical strength.

Figure 3:
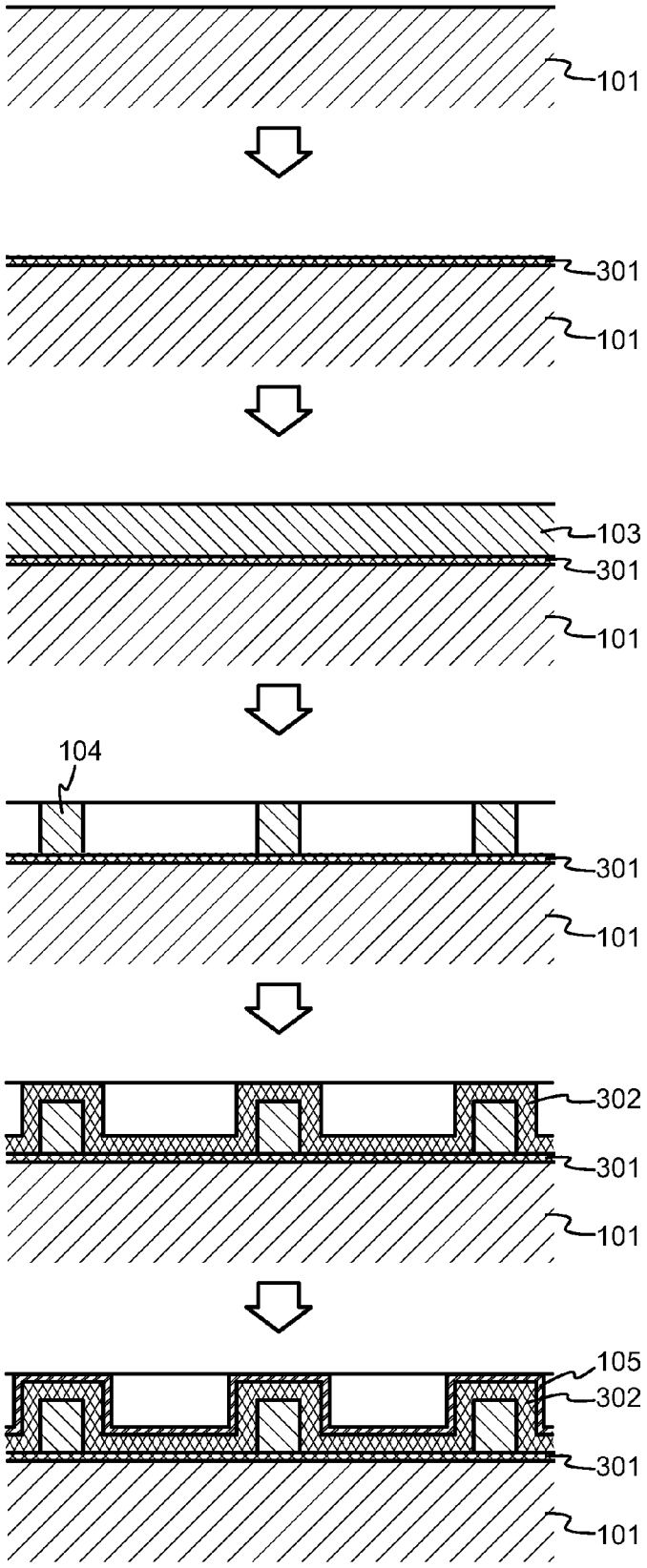
Fig. 3 PRIOR ART
FIG. 3 illustrates a variation of the method of FIG. 1.
Figure 4:
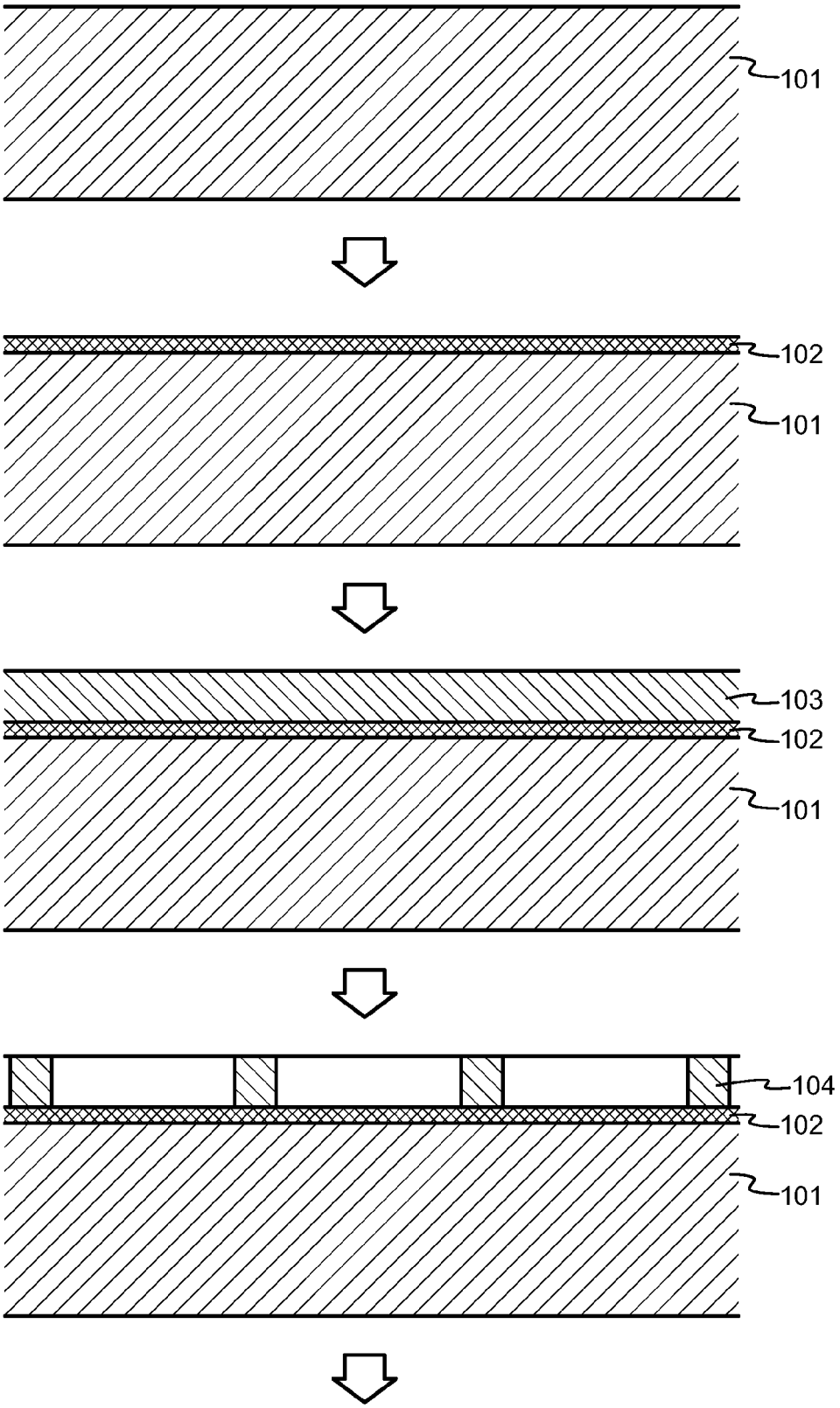
FIG. 4 illustrates a first part of a method according to an embodiment of the invention.

FIG. 1 illustrates some steps of a method for manufacturing a radiation window foil. At the topmost step, a carrier 101 is provided. For certain reasons, and as a difference to the prior art methods in FIGS. 1 and 3, the whole cross section of the carrier 101, with its top surface and bottom surface, is shown in FIG. 4. For certain other reasons, we could designate the carrier 101 also as the "second etchable layer". The material of the carrier 101 or "second etchable layer" preferably comprises crystalline semiconductor material, such as polysilicon or monocrystalline silicon. For example a portion of a semiconductor wafer can be used as the carrier 101. The thickness of the carrier 101 could be in the order of 300 to 600 micrometers, but it could also be thicker at this stage of the method.

The second step illustrated in FIG. 4 comprises forming a layer 102 on the top surface of the carrier 101. The layer 102 could be called the etch stop layer, for purposes that will become evident in the continuation. The layer 102 is extremely thin: its thickness may be between 10 and 200 nanometers. The material of the layer 102 can be for example silicon nitride and/or silicon dioxide, and it can be made for example in a chemical vapour deposition process such as LPCVD (Low Pressure Chemical Vapour Deposition) or PECVD (Plasma Enhanced Chemical Vapour Deposition). Other thin film deposition techniques could also be used, and—especially if the layer 102 comprises silicon dioxide—it could be produced by bombarding the surface of the carrier 101 with ions. Using a thin film deposition technique to produce a layer of nitride on the surface of a semiconductor wafer may be called nitriding the surface of the semiconductor wafer. Using the terminology introduced above, layers 101 and 102 are unquestionably stacked layers in the embodiment illustrated in FIG. 4.

The third step illustrated in FIG. 4 comprises forming a further layer, designated here as the first etchable layer 103, on top of the layer 102. A thin film deposition technique is preferably used to produce the first etchable layer 103, and its material comprises preferably crystalline semiconductor material, such as silicon in its polycrystalline form (so-called polysilicon). The invention does not exclude forming the first etchable layer 103 of monocrystalline silicon, but few thin film deposition techniques known at the time of writing this description enable forming a monocrystalline silicon layer on top of a silicon nitride or silicon oxide layer. The thickness of the first etchable layer 103 is preferably between 5 and 15 micrometers, but this thickness may be a final thickness that is obtained by first depositing a thicker layer and then thinning and/or smoothing it. Using a thin film deposition technique to form the first etchable layer 103, and also otherwise referring to the terminology introduced above, means that the third step illustrated in FIG. 4 represents providing a stacked layered structure in which the etch stop layer 102 is between the first etchable layer 103 and the second etchable layer 101.

Alternative methods can be used to provide the layered structure illustrated in the third step of FIG. 4. From the technology of manufacturing SOI wafers for the production of semiconductor components it is known to produce a layered structure by placing a highly polished silicon wafer against another, on the surface of which an insulator layer has been produced. Similar technology can be applied here. The surfaces that come against each other (in FIG. 4, the upper surface of the etch stop layer 102 and the lower surface of the first etchable layer 103) must be very clean and very even. In the production of SOI wafers these criteria are routinely met by using careful polishing techniques and handling the silicon wafers in a cleanroom environment. At a temperature that can be close to normal room temperature, the etch-stop-layer-covered carrier and the first etchable layer 103 are pressed gently against each other, which causes them to be bonded together through the van der Waals force. The strength of the bonding can be enhanced by subsequently increasing the temperature of the layered structure to a couple of hundreds of degrees centigrade.

A requirement placed by the SOI method explained above is that the first etchable layer 103 exists in solid, layer-like form before it comes into contact with the etch stop layer 102. This in turn sets certain minimum thickness requirements to the first etchable layer 103, although such minimum thickness requirements naturally depend on the technology that is used to produce and handle the first etchable layer 103 before bonding it to the etch-stop-layer-covered carrier. In semiconductor component manufacturing processes the thicknesses of wafers are in the order of several hundreds of micrometers: for example silicon wafers typically come in thicknesses from the 275 micrometers used for 2-inch wafers to the 925 micrometers that is expected to be a standard thickness of the future 450 millimeter wafers. Thicknesses of wafers aimed for photovoltaic components are typically in the order of 200-300 micrometers. The first etchable layer 103 may be monocrystalline, especially if it comes from a manufacturing process that was originally aimed at producing wafers for the production of semiconductor components.

After successful bonding to the etch-stop-layer-covered carrier the first etchable layer 103 does not need to be as thick anymore, because it is mechanically supported by the etch-stop-layer-covered carrier to which it is bonded.

Therefore the method may comprise thinning the first etchable layer 103 into a predetermined thickness. For example, after bonding to the etch-stop-layer-covered carrier, the first etchable layer 103 can be thinned to a thickness in the order of some tens of micrometers, like 15 micrometers. For thinning, known methods exist and are used for example in manufacturing SOI wafers. These methods may include at least one of grinding, etching, and polishing.

It should be noted that after the bonding of the first etchable layer 103 to the etch-stop-layer-covered carrier 101, and before any thinning is made, the structure may exhibit significant symmetry (depending on the original thicknesses of the carrier 101 and the first etchable layer 103). Therefore a possibility exists to switch the roles of the carrier and the first etchable layer in the continuation; for example the layer to be subsequently thinned may be the one that first received the etch stop layer on its surface. The designations "carrier" and "first etchable layer" are just names that are used in this description to illustrate the role of certain layers in a particular embodiment of the invention.

Yet another possibility for providing the layered structure of the third step in FIG. 4, particularly in stacked form, comprises implanting oxygen or nitrogen into a surface of a semiconductor wafer and annealing said surface to create a buried oxide or nitride layer within said semiconductor wafer. The carrier may be for example a disc of intrinsic crystalline semiconductor material, like monocrystalline silicon. One surface of the carrier 101 is subjected to intensive ion beam implantation with e.g. oxygen or nitrogen ions. The ion beam implantation results in an ion-implanted layer on one surface of the carrier 101. Subsequent high temperature annealing produces the layered structure illustrated in the third step of FIG. 4, in which a first etchable layer 103 exists on top of an etch stop layer 102 that remains from the ion-implanted layer. Also in this case the etchable layer(s) can be grinded, etched, and/or polished to a desired thickness. A corresponding way of creating an internal oxide layer is known from the so-called SIMOX (separation by implantation of oxygen) process that is used to produce SOI wafers.

The lowest step in FIG. 4 illustrates etching away portions of the first etchable layer to produce a first mesh or grid layer on the first (top) side of the etch stop layer 102. The cross-section of one beam or rib 104 of the first mesh or grid layer is referred to as an example. The role of the thin layer 102 as the etch stop layer is now evident: it stops the etching from reaching to the material of the carrier 101. For example, the resistance of silicon nitride and silicon dioxide (which may constitute a majority of the etch stop layer 102) to chemical etching agents such as KOH (potassium hydroxide) or TMAH (tetramethylammonium hydroxide) is much better than that of silicon (of which the first etchable layer 103 may be made), so the first etchable layer can be patterned with a suitable resist and then subjected to an etching agent to produce the first mesh or grid layer.

The beams or ribs of the first mesh or grid layer define openings that have certain shape and size. In case of a grid, the openings are elongated; in case of a mesh, the openings may be e.g. hexagonal, triangular, or rectangular, or they may have the shape of a diamond or a trapezoid defined by straight beams that intersect at oblique angles. The characteristic dimensions of the mesh may be for example in the order of 20 to 500 micrometers across each opening, with a width of the ribs in the mesh in the order of 5 to 20 micrometers.

Figure 5:
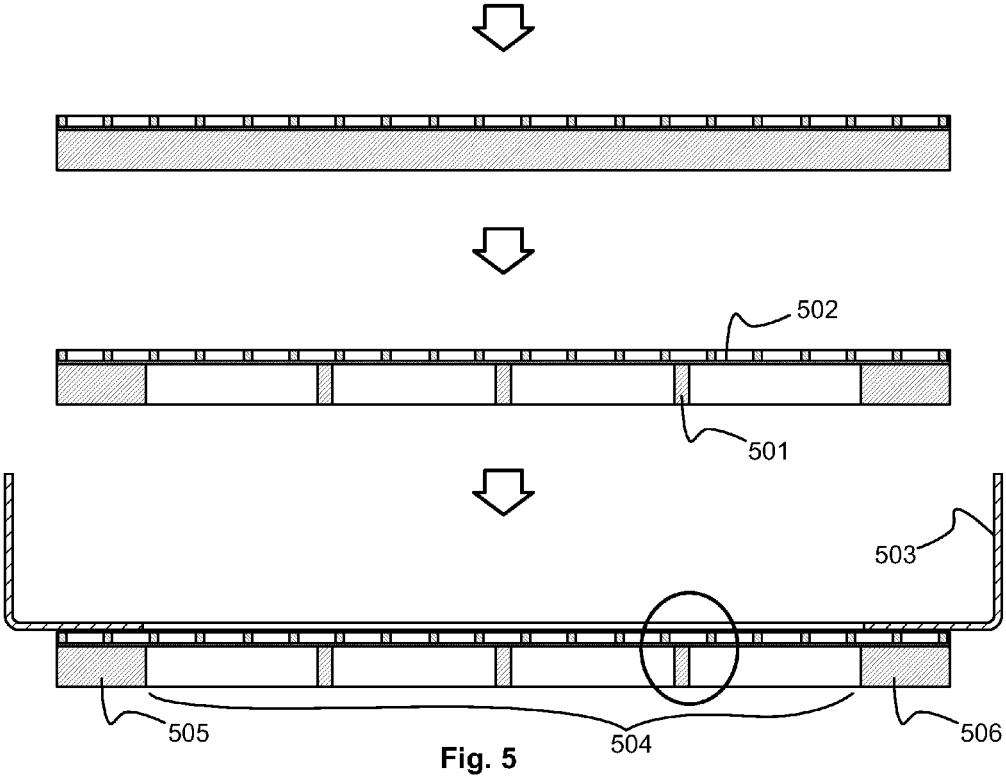
FIG. 5 illustrates a second part of the method of FIG. 4.

The topmost step in FIG. 5 illustrates essentially the same phase of the manufacturing process as the lowest step in FIG. 4, only zoomed out to illustrate a complete workpiece. However, if needed, the topmost step of FIG. 5 may also comprise thinning the carrier, i.e. the second etchable layer, to a desired thickness. The number of beams or ribs in the first mesh or grid layer is exaggeratedly small and their height exaggeratedly large in FIG. 5, in order to make them visually perceivable in the drawing. The overall horizontal dimension of the workpiece, a cross-section of which is shown in FIG. 5, may be several inches, so if each opening in the first mesh or grid layer measures 20 to 500 micrometers across, there should be hundreds to thousands of beams or ribs visible in the cross-section. Similarly the thickness of the carrier (even after thinning, if any is made) may be e.g. 20 to 120 times the thickness of the first mesh or grid layer.

The second step in FIG. 5 illustrates etching away portions of the carrier to produce a second mesh or grid layer on a second (lower) side of the etch stop layer. This explains the designation "second etchable layer" suggested for the carrier earlier. The cross-section of one beam or rib SOI of the second mesh or grid layer is referred to as an example. Just like in the previous step, in which portions of the first (upper) etchable layer were etched away to produce the first mesh or grid layer on the first (top) surface, also here the etch stop layer stops the etching from reaching to the first mesh or grid layer, which was completed already earlier.

In principle it would be possible to etch away the portions of the first etchable layer and the second etchable layer in the same etching step. However, since the difference in thickness between the two layers is so large, the etching time required by the two of them is very different, and consequently a better result is in many cases achieved by using two separate etching steps. Since the first-made mesh or grid layer is there already when the second etching begins, appropriate measures must be taken to protect the already completed mesh or grid layer during the second etching step. Basically it is possible to do the etching steps in any order, but since the carrier (i.e. the second etchable layer) has a major supporting function while it is still intact, it may be more advantageous to make the etching steps in the order in which they have been described above.

The beams or ribs of the second mesh or grid layer define openings that have certain shape and size. In case of a grid, the openings are elongated and the beams of the grid are preferably spaced at intervals between 2 millimeters and 10 millimeters; in case of a mesh, the openings may be e.g. hexagonal, triangular, or rectangular, or they may have the shape of a diamond or a trapezoid defined by straight beams that intersect at oblique angles. The characteristic dimensions of the mesh may be for example in the order of 3 to 10 millimeters across each opening. A width of the ribs in the mesh (or beams in the grid) may be in the order of 10 to 1000 micrometers.

The width of the ribs may depend, at least to a certain extent, on the thickness of the second etchable layer before etching, as well as on factors like the crystal orientation of the material of the second etchable layer. Similar considerations must be taken into account in all process steps where material is removed by etching. For example, certain crystal orientations are more prone to so-called underetching than others, for which reason they may set limits to the width-to-height ratio of patterns that are expected to remain after the etching. If the material to be etched is monocrystalline silicon, it is known that KOH etches up to 400 times faster in the 100 direction than in the 111 direction (the three-digit codes are the widely used Miller indices). TMAH exhibits similar anisotropy by etching almost 40 times faster in the 100 direction than in the 111 direction.

In the structure discussed above, if only mechanical optimisation was considered, the beams or ribs of the second mesh or grid layer should have their height to width ratio as large as possible. However, the etching method(s) to be used may prompt to make them wider, in order to avoid the beams or ribs to be eaten too thin or even destroyed by the underetching phenomenon. Also when the mask is designed for the etching, certain directions (in relation to the crystal orientation) may be deliberately favoured or avoided, in order to control the amount of underetching and the amount, quality, and edge formation of open area that is to be exposed.

Different etching methods can be combined to optimize processing time and accuracy. It has been found that a particularly advantageous combination for producing the second mesh or grid layer is to first use dry etching (for example: plasma etching) to eat away a majority (like 90%) of the silicon to be removed, and to then accomplish the final opening of the grid or mesh with wet etching in KOH or TMAH. Such a combination of etching methods is relatively fast in overall processing time, and it helps to control the crystal-orientation-dependent phenomena, because the wet etching time remains relatively short.

As with above in association with the first mesh or grid layer, the dimensions illustrated in FIG. 5 have been selected for graphical clarity only. In reality, if the workpiece measures several inches across and if the beams of the grid are preferably spaced at intervals between 2 millimeters and 10 millimeters, there should easily be dozens of beam cross-sections visible in the drawing.

The second step in FIG. 5 thus illustrates a radiation window foil according to an embodiment of the invention. It comprises a continuous window layer 502, which it what remains of the etch stop layer. The continuous window layer 502 being "continuous" means that it extends across the whole radiation window foil without any openings or discontinuities. It has a first side, which in FIG. 5 is its top side, and a second side, which in FIG. 5 is its bottom side. A first mesh or grid layer is stacked or bonded to said first side of the continuous window layer 502, where the stacked/bonded nature of the configuration comes from the method that was used to originally produce the first etchable layer: methods involving thin film deposition technologies as well as those resembling the SIMOX process result in a stacked configuration, while a process resembling the manufacturing of SOI wafers from two component wafers result in a bonded configuration.

A second mesh or grid layer is stacked on or bonded to the second side of the continuous window layer 502. Also here the stacked/bonded nature of the configuration comes from the method that was used to originally produce the etch stop layer that became the continuous window layer: methods involving thin film deposition technologies as well as those resembling the SIMOX process result in a stacked configuration. A bonded configuration could come from a process resembling the manufacturing of SOI wafers from two component wafers, if the oxide layer was first produced on what became the first etchable layer instead of on the second etchable layer.

The thickness (i.e. the characteristic dimension in the direction perpendicular to the plane defined by the radiation window foil) of the second mesh or grid layer is 20 to 120 times the thickness of the first mesh or grid layer. As an example, the thickness of the continuous window layer may be between 10 nanometers and 200 nanometers; the thickness of the first mesh or grid layer may be between 5 micrometers and 15 micrometers; and the thickness of the second mesh or grid layer may be between 300 micrometers and 600 micrometers.

The last step in FIG. 5 illustrates an advantageous way in which the radiation window foil may be used together with a radiation window frame 503 that defines an opening. A radiation window foil according to an embodiment of the invention is fixedly attached to the radiation window frame 503 and seals the opening. The radiation window frame 503 may be for example an annular piece of stainless steel or other suitable material that has suitable structural strength and other characteristics that enable attaching it both to the radiation window foil and to further structures of a radiation detector or other device in which the radiation window will be used. In the embodiment of FIG. 5 the second mesh or grid layer comprises a mesh or grid portion 504 and a frame portion that encircles said mesh or grid portion 504. Cross sections 505 and 506 of parts of the frame portion are illustrated in FIG. 5. The attachment of the radiation window foil to the radiation window frame 503 is made by the part of the radiation window foil that is covered by the frame portion.

The mutual order of the last two steps of FIG. 5 could be changed. That is, the (still not completed) radiation window foil could be attached to the radiation window frame first, and the etching away of portions of the second etchable layer to produce the second mesh or grid layer on the second side of the etch stop layer could be made only thereafter. The switched order of method steps has the advantage that the continuous, mechanically very steady second etchable layer would still be there, supporting all thinner parts of the to-be radiation window foil, preventing for example wrinkles from appearing during the process steps where the radiation window foil is attached to the radiation window frame. However, said switched order of method steps has the disadvantage that producing several pieces of radiation window foil together in a single workpiece is not possible to the same extent as when attaching to the radiation window frame is made as the last step.

In the embodiment described above we have assumed that only the second mesh or grid layer has a mesh or grid portion encircled by a frame portion. However, it is possible to make also the first mesh or grid layer have a mesh or grid portion encircled by a frame portion, preferably aligned with those of the second mesh or grid layer.

Figure 6:
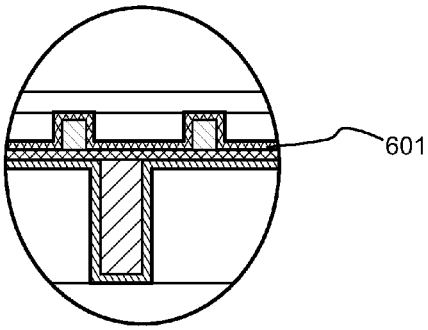
FIG. 6 illustrates one possible detailed structure.

Above we have also assumed that the layer that was originally produced as the etch stop layer would alone constitute the continuous window layer 502. However, additional layers can be used. FIG. 6 illustrates a partial enlarged portion of the radiation window of FIG. 5, coincident with the portion encircled in the last step of FIG. 5. As illustrated in FIG. 6, the radiation window foil may comprise at least one additional layer 601, for example stacked on the first mesh or grid layer. The additional layer 601 may comprise for example one or more diffusion barrier layers and/or visible light blocking layers, and it can result from e.g. a thin film deposition step that was performed after the first mesh or grid layer was made. An additional layer, for example a diffusion barrier layer and/or a visible light blocking layer, may exist also stacked on the second mesh or grid layer as shown in FIG. 6, but since the difference in thickness (i.e. in the height of the beams or ribs) between the first and second mesh or grid layers is so large, it may be more advantageous to implement additional layers (if any are needed) on the side of the first mesh or grid layer.

A class of embodiments of the invention has such an additional layer as the main layer of the foil portions that span openings in the first mesh or grid layer. The term "main layer" means that such a layer would be the principal carrier of loads that result from the surrounding gaseous substance trying to even out the pressure difference across the radiation window by flowing through one opening in the first mesh or grid layer. The previous patent publication WO2011/151506, which is incorporated herein by reference, describes in detail how such a main layer is produced after etching away the appropriate portions to make the first mesh or grid layer, but in a process step where the second etchable layer on the other side of the etch stop layer is still continuous. A feature of this class of embodiments of the invention is that the etch stop layer, which appeared as layer 102 in FIG. 4, can be as thin as the manufacturing methods allow so that it is still capable of stopping the etching; since it will never need to carry any loads, its thickness does not need to be considered in terms of any structural strength at all.

A radiation window foil according to an embodiment of the invention has truly exceptional tolerance of temperature differences, compared to known radiation window foils. A commercially available radiation window foil that is well-known and widely used at the date of writing this description can hardly tolerate an increase of temperature in the order of 40 degrees centigrade. Concerning the present invention, tests were made to evaluate the temperature tolerance of the radiation window foil by maintaining a pressure difference of one atmosphere across the foil and subjecting it to repeated temperature cycles between liquid nitrogen (−196 degrees centigrade) and a heated oven at +250 degrees centigrade. The temperature difference of almost 450 degrees centigrade did not have any noticeable effect on the gastightness or structural strength of the radiation window foil.

The exceptional tolerance of wide variations in temperature appears to be a consequence of the fact that all principal materials of the radiation window foil have their coefficients of thermal expansion very close to each other, as well as of the fact that the various layers have been integrated through processing, i.e. stacked or bonded, without any glues or other additional attaching means. In one embodiment of the invention, there are only the silicon nitride of the continuous window layer and the silicon of the first and second mesh or grid layers. The coefficients of thermal expansion of silicon nitride and silicon at room temperature are 3.2 ppm/K and 2.6 ppm/K respectively. As a comparison, the coefficients of thermal expansion of beryllium is 11.3 ppm/K, copper 16.5 ppm/K, tin-lead solder in the order of 27-30 ppm/K and epoxy about 55 ppm/K. Of pure metals, only tungsten (4.5 ppm/K, although some sources report values ranging between 5.7 and 8.3 ppm/K) comes even relatively close to silicon and silicon nitride by its coefficient of thermal expansion.

Figure 7:
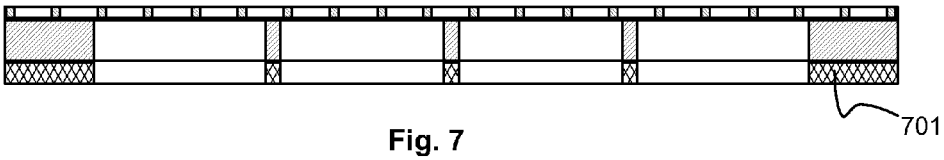
FIG. 7 illustrates the use of an additional reinforcing grid or mesh.

If the radiation window is very large and/or if it must stand very large pressure differences, the radiation window foil can be further reinforced. In the embodiment illustrated in FIG. 7, the radiation window foil comprises an additional mesh or grid layer 701 that is sandwiched on the second mesh or grid layer. Openings in the additional mesh or grid layer 701 are preferably aligned with openings in the second mesh or grid layer, so that no additional zones of high attenuation of X-rays are created. The material of the additional mesh or grid layer 701 typically comprises a metal, such as tungsten for example, or a ceramic substance. In order to ensure maintaining the alignment, it is possible to fixedly attach the additional mesh or grid layer 701 to the second mesh or grid layer, for example by glueing.

Figure 8:
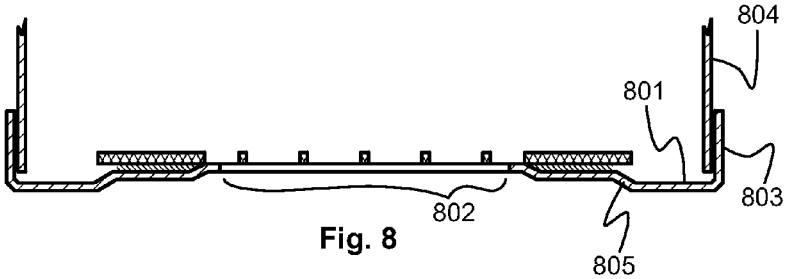
FIG. 8 illustrates a radiation window according to an embodiment of the invention.

FIG. 8 illustrates a radiation window that comprises a radiation window foil attached to a radiation window frame 801. The radiation window foil seals the opening 802 in the middle of the radiation window frame 801. It should be noted that compared to the drawings discussed so far, the radiation window foil is upside down so that the frame portion and the beams or ribs of the second mesh or grid layer appear on the upper side of the radiation window foil. The radiation window frame 801 comprises an annular disc portion, in the middle of which is the opening sealed by the radiation window foil, and a cylindrical portion 803. The last-mentioned extends upwards from the outer rim of the annular disc portion and constitutes the attachment surface by which the radiation window is attached to the so-called "can" 804, which is the basically cylindrical outer casing of a radiation detector. The attachment between the cylindrical portion 803 and the "can" 804 can be made for example by welding, glueing, or soldering.

Figure 9:
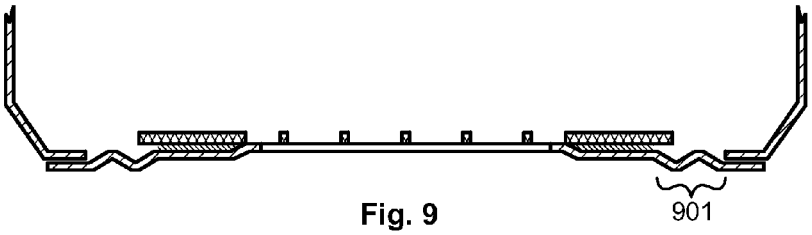
FIG. 9 illustrates a bellows zone in a radiation window.

Several precautions may be taken to avoid problems that could otherwise occur due to the different coefficients of thermal expansion of the materials. The material of the radiation window frame 801 may be selected so that its coefficient of thermal expansion is a suitable compromise between that of the radiation window foil and that of the "can" 804. Also design features of the radiation window frame 801 may be employed. In the embodiment of FIG. 8, the radiation window frame 801 has its central portion embossed out of the plane of the edge portion, so that in the cross-section a bend 805 links the two. This bend constitutes a bellows zone that surrounds those edges of the opening 802 to which the radiation window foil is attached, and gives certain flexibility to the relative movement of the central portion and the edge portion of the radiation window frame. FIG. 9 illustrates an alternative design, in which the bellows zone 901 includes more than one bend and thus gives even more flexibility. Another variation illustrated in FIG. 9 is the absence of any cylindrical portion in the radiation window frame, which is now attached (by welding, glueing, soldering, or the like) to the "can" by the outer edge of the annular disc portion.

Figure 10:
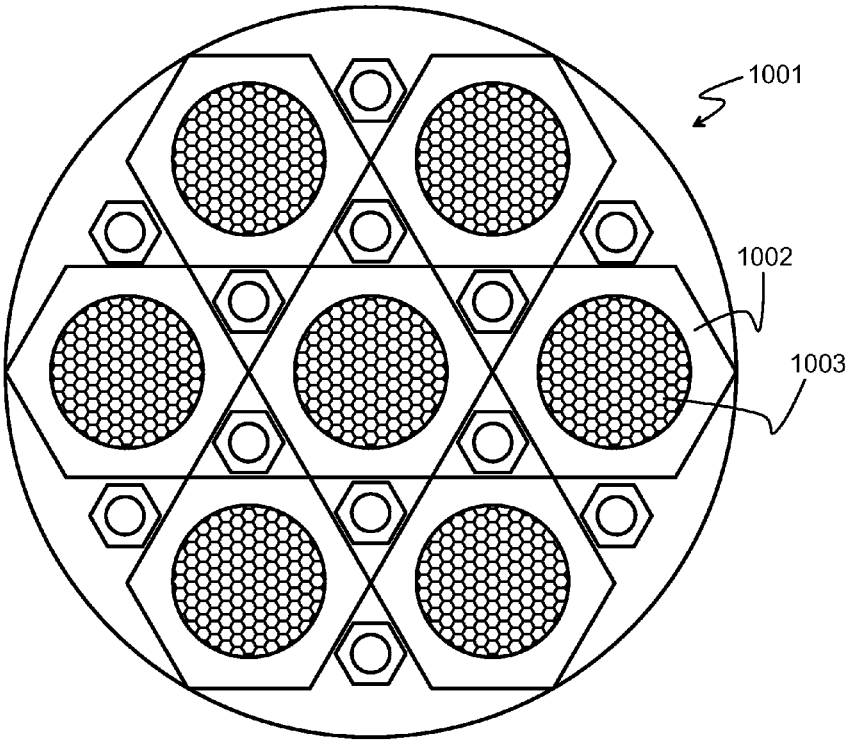
FIG. 10 illustrates the manufacturing of radiation windows from a semiconductor wafer.

FIG. 10 illustrates schematically one way of using a circular semiconductor wafer 1001 to manufacture a batch of radiation window foils. Manufacturing facilities of integrated circuits are typically arranged to handle the workpieces in the form of circular wafers. Materials such as silicon, silicon nitride, silicon oxide, and certain metals, that can be used to produce radiation window foils according to embodiments of the invention, are also frequently encountered in manufacturing processes of integrated circuits. It is advantageous to manufacture radiation window foils according to embodiments of the invention in a way that closely resembles the manufacturing of integrated circuits, because this may help to reduce the number of application-specific machinery and process steps that need to be used for the specific purpose of manufacturing radiation window foils.

The view in FIG. 10 is from the side of the second etchable layer. The etching away of portions of the second etchable layer has left frame portions (e.g. 1002) intact around mesh or grid portions (e.g. 1003). After said etching, the manufacturing method comprises cutting the common piece of material (i.e. the wafer 1001), which comprises two or more frame-portion-encircled mesh or grid portions, into pieces. Each such piece comprises one frame-portion-encircled mesh or grid portion. The smaller hexagons appearing on the wafer 1001 may comprise test pieces, which can be used for tests and measurements that reveal, how the processing of a particular wafer has succeeded. Since test pieces are not needed for eventual use in radiation windows, they can be used also for destructive testing. Naturally it is also possible that actual radiation window foils of different sizes are produced from a common wafer.

Variations to the embodiments described above are possible without departing from the scope of protection defined by the appended claims. For example, a mesh or grid does not need to repeat itself in exactly similar form across the whole of the radiation window foil, but there may be mesh or grid portions where the form of openings, pitch of beams or ribs, or other structural parameter of the mesh or grid changes either abruptly or little by little. As another example, the attachment of the radiation window foil to the radiation window frame may take place on any side of the radiation window foil, or even on both sides if the radiation window foil is squeezed between a matching pair of radiation window frame halves or if a securing ring is attached on top of the joint between the radiation window foil and an annular radiation window frame. As another example, a common radiation window foil may seal two or more adjacent openings in the radiation window frame.

We claim:

1. A radiation window foil for an X-ray radiation window, comprising:

a continuous window layer with a first side and a second side wherein said continuous window layer comprises silicon nitride, a first mesh or grid layer stacked on or bonded to said first side of said continuous window layer, and a second mesh or grid layer stacked on or bonded to said second side of said continuous window layer;

wherein both said first mesh or grid layer and said second mesh or grid layer are made of monocrystalline semiconductor material, wherein the thickness of said second mesh or grid layer is 20 to 120 times the thickness of said first mesh or grid layer, and wherein:

the thickness of said continuous window layer is between 10 nanometers and 200 nanometers, the thickness of said first mesh or grid layer is between 5 nanometers and 15 nanometers, and the thickness of said second mesh or grid layer is between 300 nanometers and 600 nanometers.

2. The radiation window foil according to claim 1, wherein:

said first mesh or grid layer is a mesh, where ribs of the mesh define openings with a dimension between 20 micrometers and 500 micrometers across each opening, and said second mesh or grid layer is a mesh, where ribs of the mesh define openings with a dimension between 3 micrometers and 10 micrometers across each opening.

3. The radiation window foil according to claim 1, comprising at least one additional layer stacked on said first mesh or grid layer, wherein said additional layer is one of:

a main layer of foil portions that span openings in the first mesh or grid layer, a diffusion barrier layer, and a visible light blocking layer.

4. The radiation window foil according to claim 1, comprising an additional mesh or grid layer sandwiched on said second mesh or grid layer, wherein openings in said additional mesh or grid layer are aligned with openings in said second mesh or grid layer, and wherein said additional mesh or grid layer comprises a metal or a ceramic substance.

5. The radiation window foil according to claim 4, wherein said additional mesh or grid layer is fixedly attached to said second mesh or grid layer.

6. A radiation window comprising:

a radiation window frame that defines an opening, and a radiation window foil according to claim 1 that is fixedly attached to said radiation window frame and seals said opening.

7. The radiation window according to claim 6, wherein:

said second mesh or grid layer comprises a mesh or grid portion and a frame portion that encircles said mesh or grid portion, and attachment of said radiation window foil to said radiation window frame is made by the part of the radiation window foil that is covered by said frame portion.

8. The radiation window according to claim 6, wherein the radiation window frame comprises a bellows zone that surrounds those edges of said opening to which said radiation window foil is attached.

9. The radiation window foil according to claim 1, wherein:

said first mesh or grid layer is a mesh, where ribs of the mesh define openings, and said second mesh or grid layer is a mesh, where ribs of the mesh define openings with a dimension between 3 micrometers and 10 micrometers across each opening, or a grid, where beams of the grid are spaced at intervals between 2 micrometers and 10 micrometers.

10. The radiation window foil according to claim 1, wherein, said first mesh or grid layer is a mesh, where ribs of the mesh define openings with a dimension between 20 micrometers and 500 micrometers across each opening, and said second mesh or grid layer is a grid, where beams of the grid are spaced at intervals between 2 millimeters and 10 millimeters.

11. The radiation window foil according to claim 1, wherein said first mesh or grid layer is a mesh, where ribs of the mesh define openings with a dimension between 20 micrometers and 500 micrometers across each opening.

12. A method for manufacturing a radiation window foil, comprising:

providing a stacked and/or bonded layered structure in which an etch stop layer of silicon nitride is between a first etchable layer of monocrystalline semiconductor material and a second etchable layer of monocrystalline semiconductor material, etching away portions of the first etchable layer to produce a first mesh or grid layer on a first side of said etch stop layer, and etching away portions of the second etchable layer to produce a second mesh or grid layer on a second side of said etch stop layer, wherein the thickness of said second mesh or grid layer is 20 to 120 times the thickness of said first mesh or grid layer, and wherein:

the thickness of said etch stop layer is between 10 nanometers and 200 nanometers, the thickness of said first mesh or grid layer is between 5 nanometers and 15 nanometers, and the thickness of said second mesh or grid layer is between 300 nanometers and 600 nanometers.

13. The method according to claim 12, comprising, for producing said layered structure:

nitriding a surface of a semiconductor wafer, and providing said first etchable layer on the nitrided surface by either forming the first etchable layer on a thin film deposition process or bonding a layer of semiconductor material on the nitrided surface.

14. The method according to claim 12, comprising:

after said etching away of portions of the first etchable layer, using a thin film deposition technique to produce a further layer onto the first mesh or grid layer produced.

15. The method according to claim 12, wherein:

said etching away of portions of the second etchable layer comprises leaving frame portions intact around mesh or grid portions, and after said etching away of portions of the second etchable layer, the method comprises cutting a common piece of material, which comprises two or more frame-portion-encircled mesh or grid portions, into pieces, each of said pieces comprising one frame-portion-encircled mesh or grid portion.

16. The radiation window according to claim 7, wherein the radiation window frame comprises a bellows zone that surrounds those edges of said opening to which said radiation window foil is attached.

17. The method according to claim 13, comprising:

after said etching away of portions of the first etchable layer, using a thin film deposition technique to produce a further layer onto the first mesh or grid layer produced.

18. The method according to claim 13, wherein:

said etching away of portions of the second etchable layer comprises leaving frame portions intact around mesh or grid portions, and after said etching away of portions of the second etchable layer, the method comprises cutting a common piece of material, which comprises two or more frame-portion-encircled mesh or grid portions, into pieces, each of said pieces comprising one frame-portion-encircled mesh or grid portion.

19. The method according to claim 14, wherein:

said etching away of portions of the second etchable layer comprises leaving frame portions intact around mesh or grid portions, and after said etching away of portions of the second etchable layer, the method comprises cutting a common piece of material, which comprises two or more frame-portion-encircled mesh or grid portions, into pieces, each of said pieces comprising one frame-portion-encircled mesh or grid portion.

* * * * *